United States Patent [19]

Little

[11] 3,936,358

[45] Feb. 3, 1976

[54] METHOD OF CONTROLLING THE FEED RATE OF QUENCH WATER TO A COKING DRUM IN RESPONSE TO THE INTERNAL PRESSURE THEREIN

[75] Inventor: James E. Little, Fort McMurray, Canada

[73] Assignee: Great Canadian Oil Sands Limited, Toronto, Canada

[22] Filed: Oct. 17, 1974

[21] Appl. No.: 515,763

[52] U.S. Cl. ..... 201/39; 201/1; 202/227; 202/228; 208/131

[51] Int. Cl.[2] ..... C10B 39/04; C10B 39/06; C10B 47/02; C10G 9/14

[58] Field of Search ..... 201/39, 35, 1, 41; 202/106, 110, 253, 262, 270, 227, 228; 208/131; 134/5.7 R, DIG. 2, 39; 196/132; 235/151.12; 261/69 R, DIG. 76; 260/698; 23/230 A, 253 A

[56] References Cited

UNITED STATES PATENTS

| | | | |
|---|---|---|---|
| 2,176,838 | 10/1939 | Fulton | 261/69 R |
| 2,331,248 | 10/1943 | Towle et al. | 261/69 R X |
| 2,725,347 | 11/1955 | Leffer | 202/106 X |
| 3,573,194 | 3/1971 | Hopper et al. | 201/35 X |

FOREIGN PATENTS OR APPLICATIONS

| | | | |
|---|---|---|---|
| 6,404 | 1897 | United Kingdom | 202/227 |
| 768,774 | 4/1955 | United Kingdom | 201/39 |
| 1,143,179 | 2/1963 | Germany | 201/39 |

*Primary Examiner*—Barry S. Richman
*Assistant Examiner*—Bradley R. Garris
*Attorney, Agent, or Firm*—George L. Church; J. Edward Hess; Richard P. Maloney

[57] ABSTRACT

In the delayed coking process wherein hot coke is formed by destructive distillation of a petroleum feed in a coking drum to provide solid coke and distillate petroleum products, the method of regulating the rate of quenching the hot coke after the drum is full and coking has ceased which comprises regulating the rate of feeding quench water to the coking drum in accordance with the internal pressure measured within the drum.

2 Claims, 1 Drawing Figure

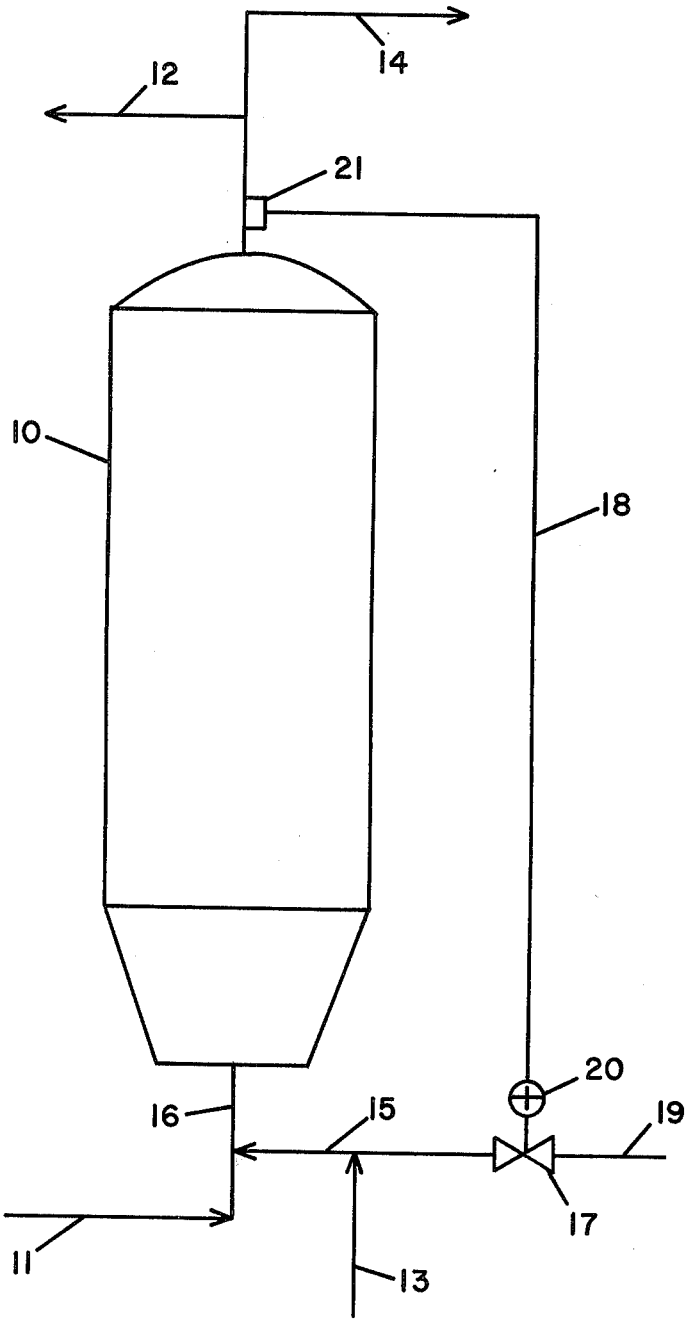
14
12
21
10
18
20
16
15
19
17
11
13

METHOD OF CONTROLLING THE FEED RATE OF QUENCH WATER TO A COKING DRUM IN RESPONSE TO THE INTERNAL PRESSURE THEREIN

BACKGROUND OF THE INVENTION

Delayed coking is a process which in general provides a means whereby a petroleum fraction is heated to a temperature at which it will thermally decompose to provide a solid coke product and a hydrocarbon distillate product. Specifically, the process provides that a heavy petroleum fraction can be fed into a coking drum under conditions which prevent the petroleum fraction from vaporizing until it has partially decomposed. The decomposition process provides a petroleum distillate which is recovered from the coking drum and a heavy tar which continues to decompose until a porous coke is deposited as a mass within the drum.

In general practice delayed coking is accomplished by first distilling a liquid petroleum feed stock until the lighter ends have been recovered and a heavy residium remains. This heavy residium is thereafter heated and fed into a coking drum wherein it is subject to temperatures up to 1000°F. to thereby effect decomposition of the petroleum to a vapor distillate product and a solid coke product. The petroleum distillate is recovered from the coke oven and a solid coarse coke remains within the drum. The vapors formed during the decomposition of the heavy residium produce pores and channels in the coke. Incoming oil from the furnace or the heater passes through these channels. Normally, fresh residium is fed to the coking drum until the drum is essentially filled with a mass of coke at which time the residium feed is discontinued and the coke is thereafter cooled and cut to be recovered.

When the coking drum is filled and feed material cut off, the coke is purged with steam to remove any remaining volatile components. After the steam purging, the coke is quenched with water to cool the coking drum and coke therein to a temperature below 200°F. This quenching operation is provided in a controlled manner so as not to subject the coking oven to excessive steam pressure created when water is fed to the coke at temperatures in the range of 700°F. to 900°F. One of the problems encountered in the delayed coking process is the substantial amount of time normally required to quench the hot coke to a point where it can be removed from the drum. By the process of the present invention, it has been discovered that the quench time of the process can be reduced by utilizing the maximum safe feed rates of quenching water into the filled coke drum.

DESCRIPTION OF THE INVENTION

It has now been discovered that the process of cooling uncut coke in a coker drum can be substantially improved by the methods of the present invention. Specifically, it has been discovered that the most efficient rate of safely cooling coke in a coker drum can be achieved by use of the methods and apparatus of the present invention. More specifically, it has been discovered that by regulating the rate of feeding quench water to a hot coke-filled coking drum to a rate determined in accordance with and in response to the internal pressure in the drum resulting from steam generated during the quench process, the rate of cooling the uncut coke therein can be maximized to provide a safe efficient method of quenching hot coke.

As one means of defining the present invention, the drawing is provided. Referring to the drawing, petroleum feed stock suitable for delayed coking is preheated to a temperature in the range of 700°F. to 900°F. by means not shown and thereafter transferred to coker drum 10 through line 16 via line 11. In coker drum 10 the petroleum feed is decomposed into solid coke and hydrocarbon vapors. The coke remains in coker drum 10 and the hydrocarbon vapors are withdrawn via line 14 and further processed by means not shown. When the drum is substantially full of coke, the petroleum feed is discontinued and steam is added to the drum via line 16 from line 15 which is fed via line 13. Steam is added in sufficient quantity to strip the remaining hydrocarbon vapors from the coke bed in the coker drum. The steam and hydrocarbon vapor mixture is withdrawn via line 12 and further processed to recover the hydrocarbons by means not shown. Thereafter the hot coke is quenched by the addition of water through 16 fed via line 15 until its temperature is reduced to a point below 200° F. The coke is then cut and removed from the drum. This general method of delayed coking is well known in the art.

The present invention provides an improvement in the quenching step of this process. The prime advantage accomplished by this improvement is the ability to safely quench the hot coke in the shortest time possible. The end result of the efficiencies enjoyed by the present invention is the shortening of the total coking cycle thereby increasing the capacity for coking of each coking drum.

In standard practice when the coking drum is filled and the petroleum feed discontinued, the coke in the drum is purged with steam followed by the addition of quench water at a very low rate until the coke is cooled. The addition of water to coke at the temperature of about 900°F. naturally generates substantial steam pressure within the coking drum. Therefore, in order to avoid excessive pressure and possible rupture of the drum, the water must be added in limited quantities until the temperature of the coke is reduced to a point where steam is no longer generated during the quenching step.

In the past the problem of overpressuring the coking drum with steam during the quenching step has been avoided by adding only small quantities of quench water over an extended period of time. This procedure although widely used and proven safe is costly in that the time of the coking cycle is substantially extended because of the slow quench procedures employed.

By the method of the present invention, quench water is added at a rate at which the maximum rate of cooling the coke in the drum is effected within safety limitations of the drum.

By the method of the present invention, the coking drum is provided with a means to detect and record the internal pressure of the drum. This pressure sensing device is connected to a means for regulating the opening in the valve controlling the quench water feed rate. The valve opening is set in accordance with the pressure limitations of the coking drum. Quench water is added to the hot coke at a rate which maintains the steam pressure in the drum at a safe level while at the same time cooling the hot coke as rapidly as possible.

The improvement achieved by the present invention can be more fully realized by again referring to the drawing. After coking a petroleum feed substantially in the manner disclosed above, the petroleum feed is discontinued. Steam is then added to coker drum 10 via line 13 through lines 15 and 16. The coke in coker drum 10 is purged with steam to remove the remaining volatile liquids. After the steam purge, quench water from line 19 is added to the coker drum 10 through valve 17 via lines 15 and 16. The rate of addition of quench water to coker drum 10 is adjusted in accordance with the internal pressure in the drum as determined by pressure indicator 21. Pressure regulating means 20 opens and closes valve 17 in response to the pressure in the coker drum as detected by indicator 21 and relayed to the pressure regulating means through line 18. Valve 17 in response to the impulse from regulator 20 opens and closes in a manner inversely proportional to the pressure measured in coker drum 10.

As an example, a coker drum having an internal volume of 32,000 cubic feet is normally operated with an internal pressure between 20 and 40 psig and has a coking cycle of 20 to 24 hours and a normal operating cycle of 40 to 48 hours. During the coking process, the overhead vapor temperature is somewhere in the range of 700°F. to 900°F. and preferably in the range of 770°F. to 840°F. The temperature of the petroleum feed stock which is fed to the coker is normally within the range of 900°F. to 1000°F., and more preferably 900°F. to 940°F.

In general practice, cokers are operated as dual units, that is, two separate coking drums in parallel having a single feed source and a single vapor recovery system. When in operation, the first coking drum receives the petroleum feed material and begins the coking cycle. When the drum is full of coke, the feed from the first coking drum is discontinued and applied to the second coking drum. While the second coking drum is going through the coking step, the first coking drum is being quenched and the coke removed.

During the quenching step, the inlet water pressure into the coke-filled drum is normally maintained in the range of 0 to 100 psig and the internal pressure of the drum is maintained in the range of 0 to 40 psig. During a normal coking cycle, about 70,000 to 80,000 pounds per hour of coke is produced in the 24 hour coking cycle. In order to more clearly illustrate the advantages of the method of the present invention, the following examples are herewith presented.

EXAMPLE I

A coker drum having an internal volume of approximately 32,000 cubic feet is fed a heavy bituminous petroleum feed stock made up of bitumen froth recovered from the hot water extraction of tar sands at the rate of 983 gallons per minute at a temperature of 940°F. maintaining internal pressure of 40 psig in the drum and providing for the recovery of vapors from the drum at approximately 800°F. to 850°F. at the rate of 1600 actual cubic feet per minute. After 20 hours of continuous feed of heated petroleum stock, the coker drum is substantially full and the petroleum feed is discontinued. Thereafter, steam at 400°F. is fed into the coker drum for 1½ hours to purge the remaining volatile hydrocarbons from the drum. Thereafter quench water at 60°F. is fed manually into the drum at increasing rates from 25 to 1000 gallons per minute at which rates it requires 6 hours to cool the coker drum to a point where the coke is cool enough to be cut from the drum.

EXAMPLE II

A coking operation identical to that disclosed in Example I is conducted under identical conditions with identical feed with the exception that the coker is provided with a pressure sensing device in accordance with the methods of the present invention to regulate the quench water fed into the drum at the end of the coking cycle. Using this device and this mechanism, coker quench water is fed beginning at 25 gallons per minute and regulated in accordance with the pressure within the coking drum for a period of 4 hours until the coke is cooled to below 200°F.

A comparison of the time of cooling the hot coke of Example I with that of Example II reveals that two hours more of cooling time was required by the method of Example I. The reason for this longer cooling time is that the water added to cool the coke of Example I was provided at a lower rate to the drum than that of Example II. The water was added at this slower rate because this rate, although lower than the possible maximum cooling rate, was known to be a rate at which the drum would not be overpressured. As demonstrated by a comparison of the time of quenching of Example II with the time of quenching achieved in Example I, the necessary time to cool the coke to a condition where it can be removed from the drum by the method of this invention is substantially reduced. Thus the present invention provides a more efficient and safe coking method by the process as herein disclosed.

The pressure sensing device suitable for use in the apparatus of the present invention can be any one of the well-known pressure sensing instruments available to the art. Mechanisms connected to the quench water feed which respond to or operate in accordance with preset conditions are standard articles of equipment well-known to those skilled in the art.

In actual operating conditions as shown in Example II and the drawing, a minimum valve opening to provide 25 gallons per minute feed of quench water is set and a maximum opening in the valve to permit the flow of 1000 gallons per minute of quench water is also preset. The valve thereafter opens and closes to provide quench water feed rates within these limits in response to the pressure readings on the pressure measuring device as transmitted through the valve actuating mechanism as shown in the drawing.

Thus the present invention comprises a method for quenching hot coke in a coker drum comprising the steps of:

a. feeding quench water to a bed of hot coke in a coker drum,
b. measuring the internal pressure in the coker drum and
c. regulating the feed rate of the quench water in response to the internal pressure in said drum.

In actual operation of the method of the present invention, quench water at about 60°F. is transferred into a coker drum full of coke. The temperature of the coke is normally within the range of 600°F. to 900°F. The quench water is fed at the initial rate of about 25 gallons per minute. The feed rate of the quench water is increased rapidly until the pressure measuring device indicates that the internal pressure in the drum is approaching the maximum safety limitations. The valve controlling the quench water feed closes and opens in response to the pressure measured in the coker drum. As the pressure approaches the preset maximum limitation, the valve closes to restrict the flow of quench water to a rate which will maintain the internal pressure of the drum below the maximum safe limit. As the coke cools, the quantity of steam generated by the quench water decreases on a volume per volume basis so that the internal pressure in the drum decreases. The flow rate of quench water is then increased by opening the quench water feed valve so that the internal pressure of the drum is maintained just below the maximum safe internal pressure limitation of the drum and thereby permit maximum cooling of the coke under safe, efficient conditions.

The invention claimed is:

1. In a process for preparing coke from a petroleum feed comprising thermally decomposing said petroleum feed in a coking drum at a temperature in the range of 700°F. to 1000°F. to provide a petroleum distillate product and a residual coke product, cooling the residual coke product with quench water, thereby producing steam which further cools the coke product and which increases the internal pressure in the coking drum the improvement which comprises measuring the internal pressure in the coking drum and in response thereto adjusting the rate of flow of said quench water to maximize said rate of flow while maintaining a substantially constant and safe internal pressure within the coking drum.

2. In a process for preparing coke from a petroleum feed comprising thermally decomposing said petroleum feed in a coking drum at a temperature in the range of 700°F to 1000°F to provide a petroleum distillate product and a residual coke product, cooling the residual coke with quench water, thereby producing steam which further cools said coke and which increases the internal pressure in the coking drum, the improvement which comprises:

a. feeding said quench water to said coking drum containing coke at a temperature above 700°F;

b. measuring the internal pressure of said coking drum; and c. regulating the feed rate of the quench water to the coking drum by:

i. decreasing the feed rate when the internal pressure of the drum increases and ii. increasing the feed rate when the internal pressure of the drum decreases so as to provide a substantially constant and safe internal pressure in said coking drum during the quenching process.

* * * * *